US005751317A

United States Patent [19]

Peeters et al.

[11] Patent Number: 5,751,317

[45] Date of Patent: May 12, 1998

[54] THERMAL INK-JET PRINTHEAD WITH AN OPTIMIZED FLUID FLOW CHANNEL IN EACH EJECTOR

[75] Inventors: Eric Peeters; R. Enrique Viturro, both of Rochester; Narayan V. Deshpande, Penfield; Joel A. Kubby; Lisa A. DeLouise, both of Rochester, all of N.Y.

[73] Assignee: Xerox Corporation, Stamford, Conn.

[21] Appl. No.: 632,293

[22] Filed: Apr. 15, 1996

[51] Int. Cl.[6] ..... B41J 2/05

[52] U.S. Cl. ..... 347/65; 347/94

[58] Field of Search ..... 347/65, 63, 94, 347/92, 93

[56] References Cited

U.S. PATENT DOCUMENTS

| | | | |
|---|---|---|---|
| 4,368,477 | 1/1983 | Heinzl et al. | 347/40 |
| 4,496,960 | 1/1985 | Fischbeck | 347/94 X |
| 4,514,742 | 4/1985 | Suga . | |
| 4,550,326 | 10/1985 | Allen et al. | 347/94 X |
| 4,630,072 | 12/1986 | Scardovi . | |
| 4,675,693 | 6/1987 | Yano et al. | 347/20 |
| 4,723,136 | 2/1988 | Suzumura | 347/65 |
| 4,882,596 | 11/1989 | Tsuzuki . | |
| 5,041,844 | 8/1991 | Deshpande | 347/65 |
| 5,278,585 | 1/1994 | Karz et al. | 347/65 |

FOREIGN PATENT DOCUMENTS

| | | | |
|---|---|---|---|
| A1-0 049 900 | 4/1982 | European Pat. Off. | B41J 3/04 |
| A2-461 940 | 12/1991 | European Pat. Off. | B41J 2/05 |
| 504879 | 9/1992 | European Pat. Off. | B41J 2/05 |
| 355100169 | 7/1980 | Japan | B41J 3/04 |
| A1-57-029463 | 2/1982 | Japan | B41J 3/04 |
| 57-167273 | 10/1982 | Japan | B41J 3/04 |
| 62-135378 | 6/1987 | Japan | B41J 3/04 |
| A1-62-135378 | 6/1987 | Japan | B41J 3/04 |
| 405104720 | 4/1993 | Japan | B41J 2/05 |

OTHER PUBLICATIONS

"A Novel Piezoelectric Valve–Less Fluid Pump" by Stemme and Stemme. The Seventh International Conference on Process Transducers, Yokohama Japan (1993) pp. 110–113.

*Primary Examiner*—Joseph W. Hartary
*Attorney, Agent, or Firm*—R. Hutter

[57] ABSTRACT

A thermal ink-jet ejector having a fluid flow channel extending between an ink inlet and a nozzle for the ejection of liquid ink therefrom, includes a rear channel diffuser disposed between the heating element and the inlet, and/or a front channel diffuser disposed between the heating element and the nozzle. Each diffuser includes an arrangement of tapers which decrease the flow impedance of liquid ink flowing toward the nozzle, and increase the flow impedance of liquid ink flowing toward the inlet. The arrangement increases the kinetic energy of droplets being ejected, and also increases the speed of re-fill of the channel with liquid ink following ejection.

15 Claims, 1 Drawing Sheet

FIG. 1
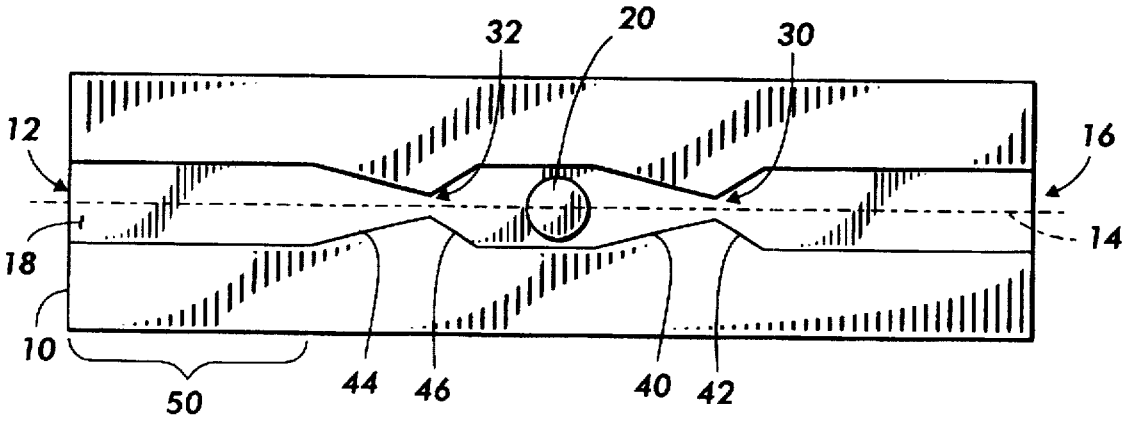
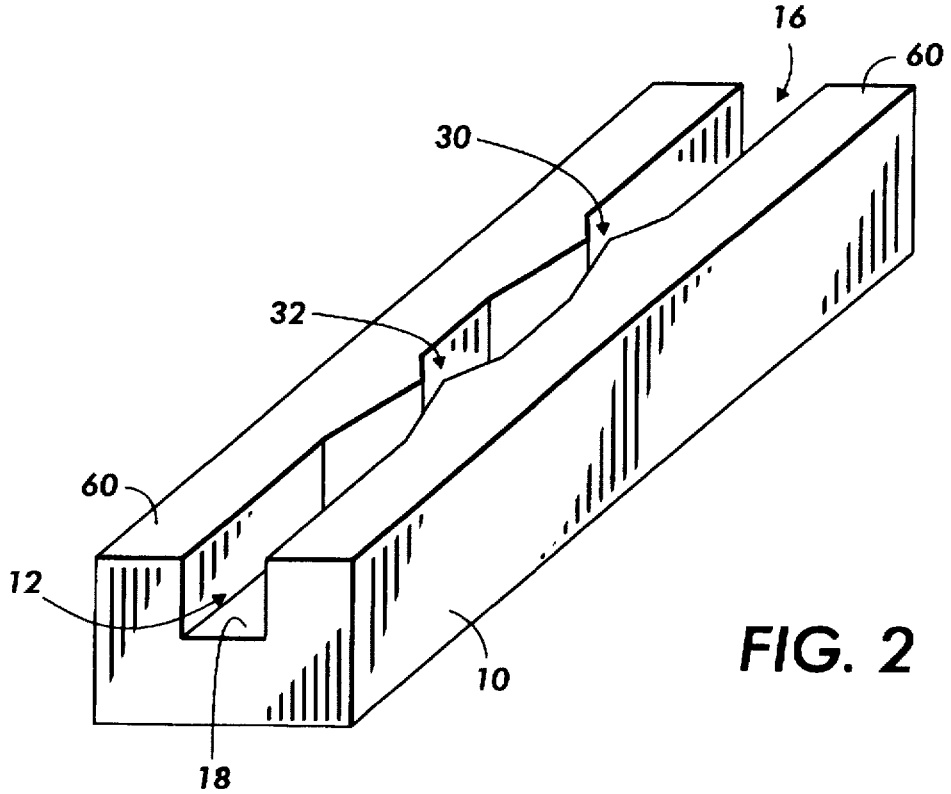
FIG. 2

THERMAL INK-JET PRINTHEAD WITH AN OPTIMIZED FLUID FLOW CHANNEL IN EACH EJECTOR

The present invention relates to a printhead for a thermal ink-jet printer, in which the fluid flow channel of each ejector is specially shaped with impedance-controlling tapers, for optimal performance.

In thermal ink-jet printing, droplets of ink are selectably ejected from a plurality of drop ejectors in a printhead. The ejectors are operated in accordance with digital instructions to create a desired image on a print sheet moving past the printhead. The printhead may move back and forth relative to the sheet in a typewriter fashion, or the linear array may be of a size extending across the entire width of a sheet, to place the image on a sheet in a single pass.

The ejectors typically comprise capillary channels, or other ink passageways, which are connected to one or more common ink supply manifolds. Ink is retained within each channel until, in response to an appropriate digital signal, the ink in the channel is rapidly heated by a heating element disposed on a surface within the channel. This rapid vaporization of the ink adjacent the channel creates a bubble which causes a quantity of liquid ink to be ejected through an opening associated with the channel to the print sheet. The process of rapid vaporization creating a bubble is generally known as "nucleation." One patent showing the general configuration of a typical ink-jet printhead is U.S. Pat. No. 4,774,530, assigned to the assignee in the present application.

In most designs of ejectors in ink-jet printheads currently in common use, the capillary channel which retains the liquid ink immediately prior to ejection is typically a simple tube of a uniform cross-section along its entire effective length. The channel may be round, square, or triangular in cross-section, but the cross-section does not vary at different points along the axis of the capillary channel. When a vapor bubble of liquid ink nucleates in such a channel, by the nature of the physics of nucleation, the expanding vapor bubble expands in all available directions. As a practical matter, such nucleation not only causes liquid ink disposed in the channel between the heating element and the nozzle to be pushed out of the nozzle, but also presents a force to liquid ink which is disposed between the heating element and the inlet to the capillary channel. In other words, in a standard-design ejector, nucleation pushes some ink out of the channel, but equally pushes a considerable quantity of ink "backwards" into the ink supply.

This backward flow of liquid ink is a source of many practical disadvantages. First, the fact that one-half of the kinetic energy provided by the heating element is not used to eject toward the print sheet represents a waste of energy and a loss of drop velocity and drop volume. Further, the fact that liquid ink is pushed back into the ink supply with every ejection causes a requirement of more time for the capillary channel to re-fill with liquid ink, and therefore puts a significant constraint on the operating frequency of an individual ejector. In brief, this two-direction flow of ink with every ejection in the standard ejector introduces a trade-off between drop velocity and/or drop volume on one hand and re-fill speed on the other hand.

The present invention proposes a design of an ink-jet ejector having a flow rectifier which minimizes the ratio of "backward" versus "forward" flow of liquid ink with each ejection.

In the prior art, the article by Stemme and Stemme, "A Novel Piezoelectric Valveless Fluid Pump," *The Seventh*

*International Conference on Process Transducers*, Yokohama, Japan (1993) pp. 110–113, which relates to PCT application WO-A-94/19609, discloses a diaphragm-type piezoelectric pump wherein fluid inlets and outlets include a constricting element having a larger pressure drop in one flow direction than in the opposite flow direction.

U.S. Pat. No. 4,368,477 discloses an ink-jet printhead in which individual ejectors are each provided with a diagonally-extending ink duct. The downstream end of each duct is formed with a wedge-shaped tapered portion, each having a leading edge wall carrying a discharge orifice for ink droplets.

U.S. Pat. No. 4,550,326 discloses a nozzle plate for a "roofshooter" printhead in which, as shown in FIGS. 8A and 8B, the orifices are tapered in front of the ink meniscus.

U.S. Pat. No. 4,675,693 discloses an ink-jet printhead in which the minimum cross-sectional area of a "discharge port" is optimized with respect to the volume of the droplets intended to be discharged.

U.S. Pat. No. 5,041,844 discloses a thermal ink-jet printhead having a channel geometry that controls the location of the bubble collapse on the heating elements. In one embodiment, the heating elements are located in a pit, and the channel portion upstream from the heating element has a length and cross-sectional flow area that is adjusted relative to the channel portion downstream from the heating element, so that the upstream and downstream portions of the channel have substantially equal ink flow impedances.

U.S. Pat. No. 5,278,585 discloses a thermal ink-jet printhead including a flow-directing one-way valve for reducing back-flow forces generated by the droplet ejecting ink vapor bubbles, so that most of the bubble generated forces are used to eject ink droplets from the printhead nozzles. A movable flap is located within the capillary channel, to restrict backflow.

According to one embodiment of the present invention, there is provided a thermal ink-jet printhead comprising at least one ejector. The ejector comprises a structure defining a fluid flow channel for passage of liquid ink therethrough. The fluid flow channel is defined along an axis extending from an inlet to a nozzle. A heating element is exposed within the fluid flow channel between the inlet and the nozzle. The fluid flow channel defines a first taper in at least one dimension along the axis, the first taper being disposed between the heating element and the inlet and opening toward the nozzle.

According to another embodiment of the present invention, there is provided a thermal ink-jet printhead comprising at least one ejector. The ejector comprises a structure defining a fluid flow channel for passage of liquid ink therethrough, the fluid flow channel being defined along an axis from an inlet to a nozzle. A heating element is exposed within the fluid flow channel between the inlet and the nozzle. The fluid flow channel defines a rear channel diffuser between the heating element and the inlet. The rear channel diffuser comprises a forward taper opening toward the nozzle and a rearward taper opening toward the inlet. A cone angle of each of the forward taper and rearward taper is selected so that flow impedance of liquid ink flowing through the rear channel diffuser toward the inlet is greater than flow impedance of liquid ink flowing through the rear channel diffuser toward the nozzle. According to another aspect of the invention, there is provided within the fluid flow channel a front channel diffuser between the heating element and the nozzle, the front channel diffuser comprising a forward taper opening toward the nozzle and a rearward taper opening toward the inlet, a cone angle of each of the forward taper and the rearward taper providing flow impedance of liquid ink flowing through the front channel diffuser toward the inlet greater than flow impedance of liquid ink flowing through the front channel diffuser toward the nozzle.

IN THE DRAWINGS

FIG. 1 is a plan view of a single ejector according to the present invention, as would be found in an ink-jet printhead; and FIG. 2 is a perspective view of the structure of a single ejector according to the present invention, shown in isolation.

FIG. 1 is a plan view of a single ejector as would be found in a thermal ink-jet printhead incorporating the present invention. As is well known, it is typical for ink-jet printheads to include 100 or more such ejectors, spaced from 300 to 600 ejectors to the linear inch. Also as is well known, each printhead is typically formed in a largely silicon structure, such as a silicon chip, having various voids etched therein to form capillary channels for the flow of liquid ink therethrough.

With reference to FIG. 1, a portion of a printhead chip, here indicated as 10, defines therein a fluid flow channel generally indicated as 12, which is aligned along an axis 14. The fluid flow channel 12 extends from an inlet port 16 to a nozzle 18. As is known in the art of thermal ink-jet printheads, liquid ink from an external supply (not shown) is introduced into fluid flow channel 12 through inlet 16, where it is retained largely by capillary force within the channel 12 until it is ejected through nozzle 18 and directed onto a print sheet.

The source of energy for ejecting liquid ink retained in channel 12 through nozzle 18 onto a print sheet is a heating element 20. In common designs of thermal ink-jet printheads, heating element 20 is in the form of an area of polysilicon which has been doped to a specific resistivity and which is covered with various protective passivation layers (not shown). The heating element 20 is connected by conductive leads (not shown) to a voltage source, which is activated when it is desired to eject a droplet of ink at a particular moment. Heating element 20 thus serves as a resistance heater which, when activated by a voltage, nucleates liquid ink which is immediately adjacent the surface thereof. This nucleation creates a vapor bubble which begins directly on the surface of heating element 20, and then expands as vaporization continues, and effectively pushes out liquid ink retained in the channel 12 between heating element 20 and nozzle 18 until the vapor bubble collapses.

As mentioned above, when heating element 20 creates a vapor bubble of liquid ink immediately adjacent thereto, not only will the expanding bubble created by heating element 20 push out liquid ink which is retained between the heating element 20 and nozzle 18, but by virtue of the equilibrium of pressure around the surface of a bubble, also push against liquid ink disposed between heating element 20 and inlet 16. When this ink is pushed against by the bubble, it follows that the ink will be pushed out of the inlet 16 and back into the ink supply. In order to minimize this undesirable back flow of liquid ink, the present invention proposes various flow-rectifying structures which influence the relative impedance along axis 14 to favor the flow of ink toward nozzle 18 as oppose to toward inlet 16.

In order to perform this adjustment of impedance, the present invention provides various tapers in the cross-section of channel 12 along axis 14. According to the present invention, the channel 12 defines a rear channel diffuser 30 and a front channel diffuser 32. With reference to rear channel diffuser 30, it can be seen that diffuser 30 comprises a first taper 40 and a second taper 42; with reference to front channel diffuser 32, it can be seen that the diffuser comprises a third taper 44 and a fourth taper 46.

For each of the rear channel diffuser 30 and the front channel diffuser 32, the intention of the two tapers is that the relatively gradual taper toward the direction of the nozzle, and the relatively sharp tapers toward the direction of the inlet, have the function of creating a high impedance of ink flow in the direction toward the inlet 16, and a relatively low impedance for the flow of ink toward the direction of the nozzle 18. Thus, the rear channel diffuser 30 has a high impedance during the ejection of a droplet of liquid ink through nozzle 18, and a low impedance for ink entering the channel 12 through inlet 16 during re-fill. With respect to front channel diffuser 32, it will be seen that there will be a low impedance for ink being pushed through the diffuser toward the nozzle 18, but a higher impedance for any ink being drawn inward from nozzle 18, which may occur in a manner to be described in detail below.

In one practical embodiment of the present invention, the preferred angles for the high-impedance tapers such as 40, 44 is not more than 30 degrees in total "cone angle," that is, from one wall of channel 12 to the other. In general, in the context of ink-jet printing, 30 degrees has been found to be above the critical angle for the desired impedance effect, this being the angle at which the liquid ink releases from the wall of channel 12 at a given velocity. Under commonly-expected conditions of ink composition and ejection frequency, an optimum cone angle has been found to be about 10 degrees for the forward-facing tapers. With respect to the tapers 42 and 46, the preferred cone angles for these tapers should be greater than 30 degrees but may be as high as 90 degrees or more. (As used in the claims herein, it will be understood that the "cone angle" refers to a taper of the fluid flow channel in at least one dimension, in the case of a fluid flow channel of rectangular cross-section; it will be understood that such a cone angle concept can apply equally to a semicircular or circular cross-section as well. Further, in certain of the claims, each of the rear channel diffuser 30 and front channel diffuser 32 are described as having forward facing and rearward facing tapers, forward facing tapers opening toward the nozzle and rearward-facing tapers opening toward the inlet.)

Thus, for a nucleating bubble of vaporized ink originating from heating element 20, the liquid ink being pushed out from this bubble will face a high impedance from taper 40, and a relatively low impedance from taper 46. This lower impedance through front channel diffuser 32 will cause more ink to be pushed through nozzle 18 than backwards towards inlet 16, in the finite time of ejection before the vapor bubble collapses. In this way, the back flow toward inlet 16 is reduced with every ejection.

After the ejection of liquid ink from nozzle 18, a new supply of liquid ink must be loaded into channel 12 through inlet 16. The nature of taper 42 of rear diffuser 30 creates a low-impedance flow into the bulk of channel 12. During the vapor bubble collapse, the high-impedance property of taper 44 presents a high impedance for liquid ink to flow from the space in channels 12 between front channel diffuser 32 and nozzle 18, hence maximizing the re-use of bubble collapse energy for refill of the fluid flow channel through inlet 16 and diffuser 30. It follows that less liquid ink needs to be supplied by slow capillary refill action through inlet 16, hence reducing the refill time and increasing the maximum print speed.

According to a preferred embodiment of the present invention, there is further provided within channel 12 an extended portion generally indicated as 50, between the taper 44 of front channel diffuser 32 and nozzle 18. Following the ejection of a droplet of liquid ink through nozzle 18, the presence of extension 50 will cause a small quantity of liquid ink to remain in channel 12 even after ejection. This small quantity of liquid ink which will remain generally in the area of extended portion 50 can serve as a liquid seal to enhance the speed and efficiency of the re-fill of liquid ink from inlet 16. The small remainder of liquid ink facilitated by extended portion 50 also prevents the undesirable intake of air during the re-fill stage; if any air is sucked back during the re-fill stage beyond front channel diffuser 32, the presence of this stray air bubble before ejection will have an undesirable effect on the amount of ink ejected in the next ejection, and may also damage the printhead, if in the next ejection the heating element 20 has no liquid ink thereagainst to absorb heat energy. The extent of extended portion 50 relative to the rest of the channel 12 will vary by specific design, but as a general guideline, it is desirable that the extra volume to channel 12 provided by extended portion 50 be approximately equal to one-half the volume encompassed between heating element 20 and taper 46. As a practical matter, what is important is that extended portion 50 be long enough to cause a "bridge" of liquid ink, effectively sealing nozzle 18, to remain therein after each ejection.

With the channel design of the present invention, two key advantages are obtained: first, more ink is ejected through nozzle 18 than through inlet 16 with every ejection, and the flow of liquid ink to re-fill the channel 12 after an ejection is enhanced. In the ongoing operation of a particular ejector, these two advantages have the effects of (a) increasing the kinetic energy of each droplet emitted through the nozzle; and (b) increasing the speed of re-fill, thereby increasing the maximum possible frequency of operation, which is the time between ejections.

The various trade-offs involved in designing a specific version of the ejector of the present invention can be summarized by the following equation:

$$P_{max} = \left( \frac{m \cdot v^2}{2} \right) \cdot f_{max}$$

where $P_{max}$=maximum kinetic power (kinetic energy per unit time)of an ejected droplet; m=mass of an ejected droplet; v=velocity of an ejected droplet; and $f_{max}$= maximum frequency of ejection (i.e., the inverse of the ejection plus refill time).

In general, it has been found that the design trade-off between droplet volume and droplet velocity summarized by the above equation can be manifest by the selection of neck width between the forward- and rearward-facing tapers for each diffuser. The presence of a front channel diffuser such as 32 may have the effect of decreasing the size of an ejected droplet relative to a straight-sided channel 12 of similar dimensions. However, in some contexts, the emission of a smaller droplet of ink may be desirable from a standpoint of ink absorption by paper.

FIG. 2 is a perspective view, not to scale, of the channel 12 formed in section 10 as shown in the plan view of FIG. 1. It will be noted that, according to presently-practical techniques of fabrication of ink-jet printheads, that the channel of the present invention is formed in the surface of a substrate, such as a silicon chip, leading to a channel 12 having a rectangular cross-section. Although it may be preferable to provide a nozzle having circular cross-section or semicircular cross-sections, the use of a rectangular cross-section as shown in FIG. 2 is effective at obtaining the desired impedances. The cross-sectional area of the flow path through fluid flow channel 12 can be kept constant despite the constrictions of channel diffusers 30 and 32, by using deeper channels with a rectangular cross-section.

In order to obtain the desired profile of the fluid flow channels 12 according to the present invention, it is preferred to use dry-etching techniques, such as reactive ion etching, on silicon or other materials. Channels can be formed in the surface of a silicon chip, as shown in FIG. 2, and then another layer can be added over the main surface 60 of the chip as shown in FIG. 2, in order to enclose the channel 12. An alternate technique is to form the desired profiles of channels 12 in a layer of polyimide, and sandwich this layer of polyimide between two silicon chips, one or both of which may include a heating element 20 defined therein in an appropriate place.

While the invention has been described with reference to the structure disclosed, it is not confined to the details set forth, but is intended to cover such modifications or changes as may come within the scope of the following claims.

We claim:

1. A thermal ink-jet printhead comprising at least one ejector, the ejector comprising:

a structure defining a fluid flow channel for passage of liquid ink therethrough, the fluid flow channel being defined along an axis extending from an inlet to a nozzle;

a heating element exposed within the fluid flow channel between the inlet and the nozzle;

the fluid flow channel defining a first taper in at least one dimension along the axis, the first taper disposed between the heating element and the inlet and opening toward the nozzle, the first taper defining a first cone angle;

the fluid flow channel defining a second taper in at least one dimension along the axis, the second taper being disposed between the heating element and the nozzle and opening toward the inlet, the second taper defining a second cone angle greater than the first cone angle;

the fluid flow channel defining a third taper in at least one dimension along the axis, the third taper being disposed between the heating element and the inlet and opening toward the inlet;

the fluid flow channel defining a fourth taper in at least one dimension along the axis, the fourth taper being disposed between the heating element and the nozzle and opening toward the nozzle; and the fluid flow channel defining an extension between the fourth taper and the nozzle, the extension encompassing a volume at least equal to one-half a volume encompassed by the capillary channel between the heating element and the second taper.

2. The printhead of claim 1, the first taper defining a cone angle of not more than 30 degrees.

3. The printhead of claim 1, the second taper defining a cone angle of not less than 30 degrees.

4. The printhead of claim 1, the third taper defining a cone angle of not less than 30 degrees.

5. The printhead of claim 1, the fourth taper defining a cone angle of not more than 30 degrees.

6. A thermal ink-jet printhead comprising at least one ejector, the ejector comprising:

a structure defining a fluid flow channel for passage of liquid ink therethrough, the fluid flow channel being defined along an axis extending from an inlet to a nozzle;

a heating element exposed within the fluid flow channel between the inlet and the nozzle;

the fluid flow channel defining a rear channel diffuser between the heating element and the inlet, the rear channel diffuser comprising a forward taper opening toward the nozzle and a rearward taper opening toward the inlet, a cone angle of each of the forward taper and the rearward taper being selected together so that flow impedance of liquid ink flowing through the rear channel diffuser toward the inlet is greater than flow impedance of liquid ink flowing through the rear channel diffuser toward the nozzle; and the fluid flow channel defining a front channel diffuser between the heating element and the nozzle, the front channel diffuser comprising a forward taper opening toward the nozzle and a rearward taper opening toward the inlet, a cone angle of each of the forward taper and the rearward taper being selected so that flow impedance of liquid ink flowing through the front channel diffuser toward the inlet is greater than flow impedance of liquid ink flowing through the front channel diffuser toward the nozzle.

7. The printhead of claim 6, the cone angle of the forward taper of the rear channel diffuser being not more than 30 degrees.

8. The printhead of claim 6, the cone angle of the rearward taper of the rear channel diffuser being not less than 30 degrees.

9. The printhead of claim 6, the cone angle of the forward taper of the front channel diffuser being not more than 30 degrees.

10. The printhead of claim 6, the cone angle of the rearward taper of the front channel diffuser being not less than 30 degrees.

11. The printhead of claim 6, the fluid flow channel defining an extended portion between the forward taper of the front channel diffuser and the nozzle, the extended portion encompassing a volume at least equal to one-half a volume encompassed by the fluid flow channel between the heating element and the rearward taper of the front channel diffuser.

12. A thermal ink-jet printhead comprising at least one ejector, the ejector comprising:

a structure defining a fluid flow channel for passage of liquid ink therethrough, the fluid flow channel being defined along an axis extending from an inlet to a nozzle;

a heating element exposed within the fluid flow channel between the inlet and the nozzle; and the fluid flow channel defining a front channel diffuser between the heating element and the nozzle, the front channel diffuser comprising a forward taper opening toward the nozzle and a rearward taper opening toward the inlet, a cone angle of each of the forward taper and the rearward taper providing flow impedance of liquid ink flowing through the front channel diffuser toward the inlet greater than flow impedance of liquid ink flowing through the front channel diffuser toward the nozzle.

13. The printhead of claim 12, the cone angle of the forward taper of the front channel diffuser being not more than 30 degrees.

14. The printhead of claim 12, the cone angle of the rearward taper of the front channel diffuser being not less than 30 degrees.

15. The printhead of claim 12, the fluid flow channel defining an extended portion between the forward taper of the front chanel diffuser and the nozzle, the extended portion encompassing a volume at least equal to a volume encompassed by the capillary channel between the heating element and the rearward taper of the front channel diffuser.

* * * * *